US005550624A

United States Patent [19]

Wachtler

[11] Patent Number: 5,550,624

[45] Date of Patent: Aug. 27, 1996

[54] ELECTROPHOTOGRAPHIC PRINTING DEVICE FOR THE SIMULTANEOUS PRINTING OF BOTH SIDES OF A RECORDING MEDIUM

[75] Inventor: Rudolf Wachtler, Hohenpolding, Germany

[73] Assignee: Siemens Nixdorf Informationssysteme Aktiengesellschaft, Paderborn, Germany

[21] Appl. No.: 318,701

[22] PCT Filed: Mar. 4, 1993

[86] PCT No.: PCT/DE93/00195

§ 371 Date: Oct. 11, 1994

§ 102(e) Date: Oct. 11, 1994

[87] PCT Pub. No.: WO93/21566

PCT Pub. Date: Oct. 28, 1993

[30] Foreign Application Priority Data

Apr. 10, 1992 [DE] Germany ..... 42 12 144.2

[51] Int. Cl.[6] ..... G03G 21/00

[52] U.S. Cl. ..... 355/319; 355/271; 355/272; 355/282

[58] Field of Search ..... 355/271, 272, 355/277, 279, 309, 319, 202, 326 R, 275, 273, 282, 285, 290, 289, 210

[56] References Cited

U.S. PATENT DOCUMENTS

| | | | |
|---|---|---|---|
| 3,694,074 | 9/1972 | Bhagat . | |
| 4,427,285 | 1/1984 | Stange . | |
| 4,455,079 | 6/1984 | Miwa et al. | 355/279 |
| 4,542,978 | 9/1985 | Tarumi et al. | 355/279 |
| 4,657,373 | 4/1987 | Winthaegen et al. | 355/275 |
| 4,958,187 | 9/1990 | Tsuchiya et al. | 355/202 |
| 5,057,875 | 10/1991 | Itoh | 355/326 R |
| 5,115,277 | 5/1992 | Camis | 355/273 |
| 5,196,893 | 3/1993 | Nishise et al. | 355/271 |

FOREIGN PATENT DOCUMENTS

| | | |
|---|---|---|
| 0154695A1 | 12/1984 | European Pat. Off. . |
| 0399794A2 | 11/1990 | European Pat. Off. . |
| 0478820A1 | 4/1992 | European Pat. Off. . |
| 3324996A1 | 1/1984 | Germany . |
| 56-16156 | 12/1981 | Japan . |
| 61-117582 | 6/1986 | Japan . |
| WO91/13386 | 9/1991 | WIPO . |

*Primary Examiner*—Sandra L. Brase
*Attorney, Agent, or Firm*—Hill, Steadman & Simpson

[57] ABSTRACT

An electrophotographic printing device for the simultaneous printing of both sides of a recording medium contains two printing modules each having an associated electrophotographic processor which are secured opposite one another in the printing device in such a way that a conveyor channel for the recording medium is opened between the printing modules. The recording medium passes over a guide designed as a pair of rollers so that it can be brought into contact with its rear side and/or its front side with the associated intermediate carrier of the respective printing modules. The guide roller for the intermediate carrier in cooperation with a counter roller or the guide rollers arranged in opposition for the intermediate carrier serve here as pairs of rollers.

8 Claims, 2 Drawing Sheets

ELECTROPHOTOGRAPHIC PRINTING DEVICE FOR THE SIMULTANEOUS PRINTING OF BOTH SIDES OF A RECORDING MEDIUM

BACKGROUND OF THE INVENTION

1. Field of the Invention

The present invention relates to an electrophotographic printing device and more particularly the invention relates to an electrophotographic printing device, for the simultaneous printing of both sides of a recording medium.

2. Description of the Related Art

An electrophotographic printing device with which a recording medium can be printed on both sides is known from PCT Application WO-91/13386. The electrophotographic printing device described therein, in particular for printing single sheets, contains one or more printing modules in which the processing means for carrying out the electrophotographic process are grouped together. The printing modules are designed as separate assemblies for to be secured in a housing of the printing device and have fitting elements for fitting the printing modules next to one another in the housing. Each printing module contains an intermediate carrier with associated fixing elements for transferring a toner image generated on a photoconductor drum onto a recording medium and fixing it there. The printing device can be extended from a single-color simplex printer to a multi-color duplex printer by multiple arrangement of the printing modules.

Another electrophotographic printing device which has two identical printing modules disclosed in this design is described in European Patent EP-A2-0 399 794. The printing modules are secured in such a way that a conveyor channel for the recording medium opens between them, heating means being provided on guide rollers for the simultaneous fixing of the toner images generated on the photoconductors.

An additional method for printing both sides of a recording medium with an electrophotographic printing device is described in U.S. Pat. No. 3,694,073, in which a toner image is transferred onto a front side of the recording medium with the aid of a first photoconductor drum and a toner image is transferred onto the rear side with second photoconductor drum. The toner images are fixed over several stages. First, a radiator following the first photoconductor drum partially fixes the toner so that the recording medium does not heat up too much and consequently the transfer of the toner image at the second photoconductor drum is not hindered. A further partial fixing is performed by a further radiator following the second photoconductor drum. The actual overall fixing of the toner images is performed by a subsequent fixing station with amplified radiators arranged on both sides of the recording medium.

This multi-stage fixing is necessary because the toner image is made up of loose toner particles that can become detached from the recording medium between the photoconductors. Multiple applications of heat on the recording medium in the course of the printing process deforms and stresses the recording medium which is made of paper. This impairs the print quality and the paper handling. In addition, the multiple arrangement of radiators with a high power consumption requires a powerful power supply with physical dimensions. This restricts the flexible use of the printing device.

With object of present invention is to provide an electrophotographic printing device of simple design for the simultaneous printing of both sides of a recording medium, which is not prone to malfunctions and which ensures gentle handling of the recording medium with the lowest possible power consumption.

A further object of the present invention is to construct the printing device in such a way that it can be constructed using standard parts depending on the specific requirements of customers.

These and other objects of the present invention are accomplished by the electrophotographic printing device of the present invention.

SUMMARY OF THE INVENTION

A printing device of simple design that is not prone to malfunction is produced by using printing systems of standard design that are arranged opposite one another in the printing device so that a conveyor channel is opened for the recording medium between the printing systems, and by the placement of corresponding guide means for the recording medium which is simultaneously printed and fixed in the conveyor channel. It is designed for the simultaneous printing of both sides of a continuous recording medium. A clearly defined paper path, between a supply area and a pick-up area, through the printer without any significant deflections allows gentle and stress-free handling of the recording medium, which has a positive effect on the print quality. This is particularly favorable if recycled paper or similar paper with a highly variable composition is used as the recording medium. Since the paper is in essence heated only once during its passage through the printing device, the power consumption is minimal and the deforming effect of thermal fixing stations on the recording medium is considerably reduced. The rolling and polishing effects on the surface of the recording medium which impair the print quality do not occur.

As a result of the low printing interval between generating the front and rear side, the memory requirement in the printer controller (page memory etc.) is substantially reduced.

The advantage described are enhanced yet further if, according to one embodiment of the invention, a pair of rollers is used as guide means in the conveyor channel which has opposing guide rollers around which the respective intermediate carrier is wound, between which the recording medium is passed in a print transfer and fixing gap.

These and other features of the present invention are discussed in greater detail below in the following detailed description of the presently preferred embodiments with reference to the accompanying drawings.

Embodiments of the invention are illustrated in the drawings and will be described in greater detail below by way of example.

DETAILED DESCRIPTION OF THE PREFERRED EMBODIMENTS

Figure 1:
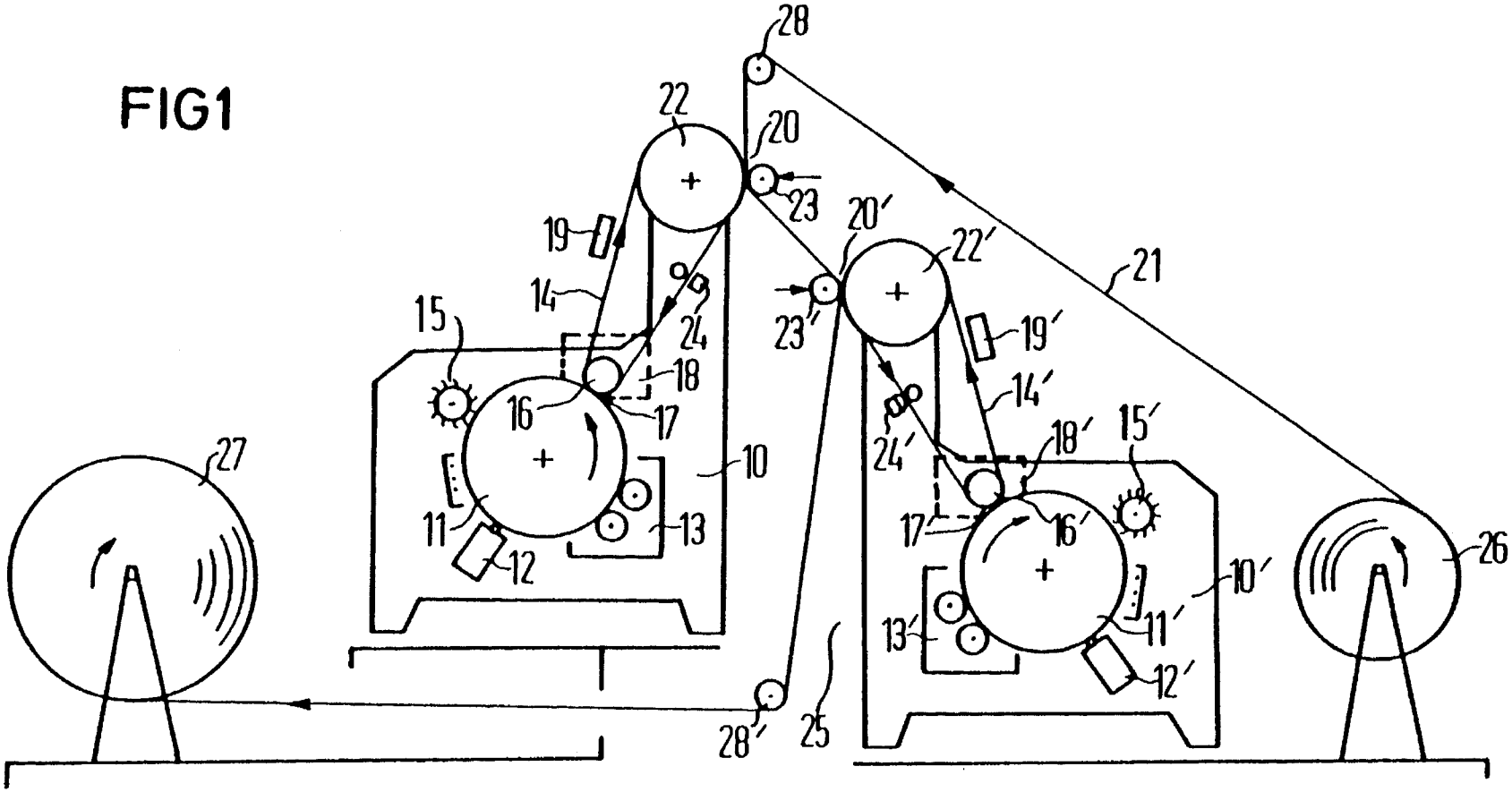
FIG. 1 shows a diagrammatic representation of electrophotographic printing device of the present invention for simultaneously printing both sides of a recording medium with two opposed printing systems.

The electrophotographic printing device illustrated in FIG. 1 provides for the simultaneous printing of both sides of a belt-shaped recording medium, and it is also suitable for printing single sheets given the appropriate design for the paper path. It contains two printing modules 10 and 10', which contain the processing means for printing the recording medium. The processing means each comprise: a photoconductor drum and 11', respectively that can be driven by an electromotor with associated illumination means and 12', respectively for generating a charge image on the surface of the photoconductor drum; a developer station and 13', respectively for inking the charge image with toner; a continuous belt-shaped intermediate carrier and 14' respectively for transferring a toner image produced by inking the charge image on the photoconductor drum onto the surface of the recording medium; fixing means that will be described in more detail later for pressure/heat fixing the toner image on the recording medium and cleaning means 15 and 15' respectively for cleaning the intermediate carriers and the photoconductors 11 and 11'. The cleaning means for the photoconductor may comprise a fleece belt and a brush cleaning station operating with negative pressure. Corona discharging and charging devices are also provided in addition for discharging and charging the photoconductor drum. An LED character generator, which extends over the entire length of the photoconductor drum 11 and 11' and which is driven to generate the charge image on the photoconductor drums 11 and 11' in a character-dependent manner by a character generator of the device, serves as illumination means 12 and 12' respectively.

The intermediate carriers 14 and 14' are arranged for transferring the toner image onto the recording medium 21 which comprises a rubber or silicone belt, called a thermal transfer belt, mounted on guide rollers 16' which touches the surface of the photoconductor drums 11 and 11' in the region of a print transfer station 17. A motor device 18 which may be arranged if necessary allows the intermediate carrier 14 or 14' to be swung into and away from the photoconductor drum 11 or 11' when required. By appropriate heating of the intermediate carriers 14, 14' or of the photoconductor drums 11, 11' respectively, the temperature at the print transfer stations 17, 17' are set in such a way that the toner of the toner image is in a pasty state and is transferred onto the intermediate carriers 14, 14' by adhesive force. The transfer can however also be accomplished electrostatically via a corresponding corona station. The toner image on the intermediate carriers 14, 14' are heated up in subsequent heating station 19 having heating elements arranged therein to such a degree that the toner is almost liquefied, but still just remains in the solid state of aggregation. The almost liquid toner image is transferred onto the recording medium 21 at print transfer stations 20 and 20' respectively for the recording medium 21. For this purpose, the print transfer stations 20, 20' contain a pair of rollers comprising a guide roller 22 and 22' respectively with a large diameter and a counter roller 23 and 23', respectively between which the recording medium 21 is passed. It may be favorable to pre-heat the recording medium 21 by means of a warming station before it enters the print transfer station 20 (this preheating being at a temperature far below a temperature necessary to achieve fixing of the toner).

The fixing capability can be improved in this manner. The intermediate carriers 14, 14' are subsequently cleaned in a cleaning station 24' or 24 respectively. For this purpose the cleaning stations 24, 24' contain a cleaning roller with associated pressure roller. The cleaning roller removes toner residues from the intermediate carriers 14, 14' mechanically or chemically, which are then stripped off from the cleaning roller at a correspondingly designed fleece element or in a cleaning bath. It may furthermore be favorable to arrange a transport and temperature stabilizing unit following the cleaning stations 24, 24' in the transport direction of the intermediate carrier, which adjusts the intermediate carriers 14, 14' to a constant temperature. The photoconductor drums 11, 11' can contain an electrically heated heating element as an additional heating means for heating up the print transfer station 17 and 17' respectively.

All the abovementioned processing means are secured using corresponding mounting or securing means on chassis elements of the printing modules 10 and 10' respectively.

In order to be able to print both sides of the recording medium 14 and 14' simultaneously with the electrophotographic printing device two identically constructed printing modules 10 and 10' are arranged opposite one another in the printing device in such a way that a conveyor channel 25 is opened between the printing modules, through which the recording medium 21 is passed, starting from a supply roller 26, represented only diagrammatically here, to a take-up roller 27. Respectively arranged guide rollers, 28' serve to feed the recording medium 21 in and out in the region of the printing modules 10 and 10'. A central controller which is connected to both printing controls, printings the print transfer takes place at the print transfer station 20 of the printing module 10 with simultaneous fixing of a rear page toner image on the rear side of the recording medium 21, and in the immediately following print transfer station 24' of the second printing module 10' a print transfer takes place with simultaneous fixing of a front side image on the front side of the recording medium 21. One of the rollers, 22' or 23' of the pair of rollers can be additionally heated to assist the print transfer and fixing operation at the print transfer stations 20 and 20'.

If one wishes to print the front or rear side alternately, or print only the front or only the rear side, then it is possible to swing the intermediate carrier 14 or 14' of the printing modules 10/1 or 10/2 respectively that is not being used in and out with the aid of the electromotor device 18 or 18' respectively when required. For this purpose, it is however also possible for the respective guide rollers 22, 22' or the counter rollers 23, 23' to be designed in such a way that they can be swung in and out. A possible alteration of the paper path can be corrected via the control circuit for the printing modules 10, 10', or it may be automatically taken into account when generating the image on the photoconductor drums.

Figure 2:
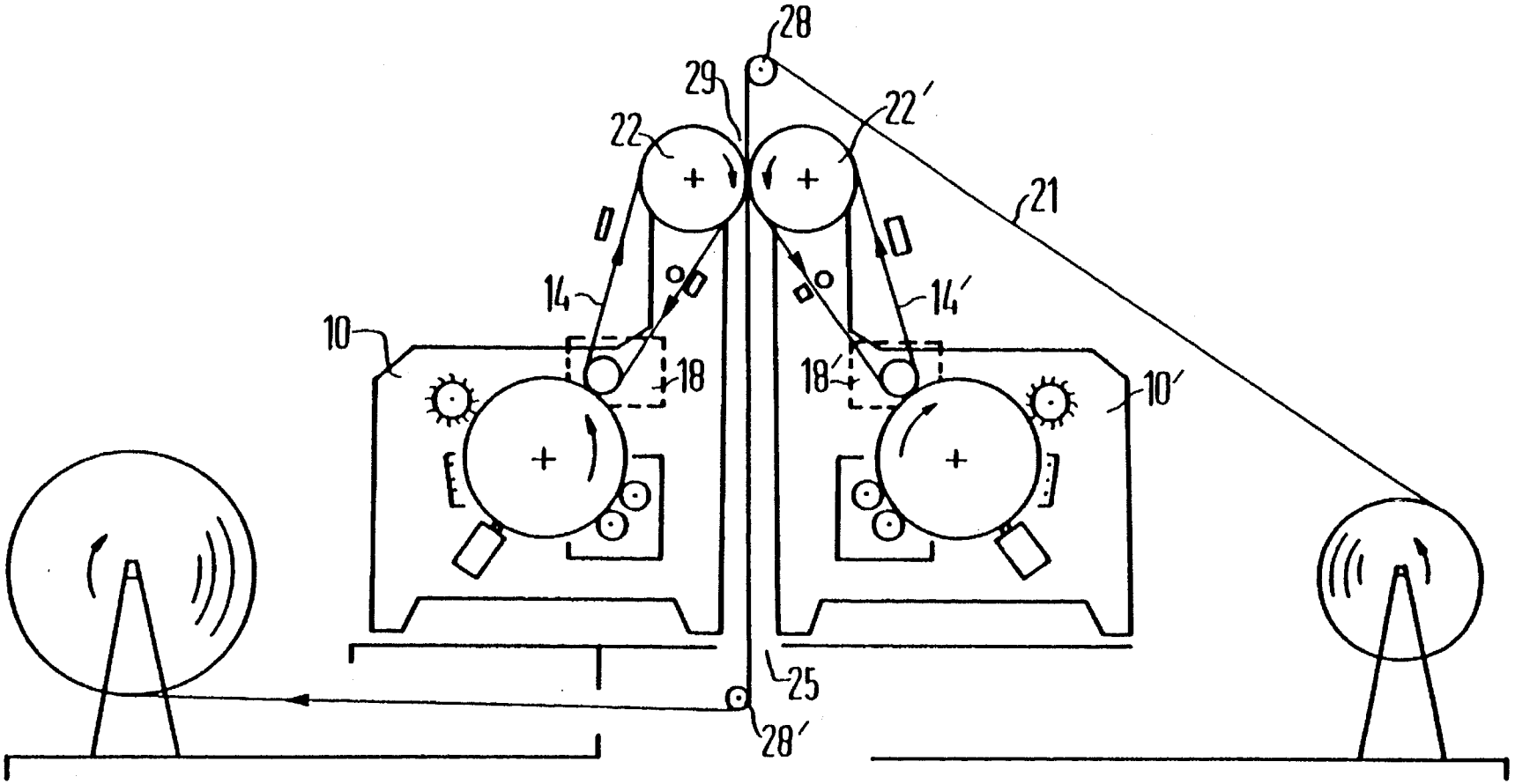
FIG. 2 shows a diagrammatic representation of the electrophotographic printing device of the present invention having, two opposed printing systems and a shared print transfer and fixing station.

A particularly simple design of the electrophotographic printing device that is gentle on the paper is produced by an arrangement of the printing modules 10 and 10' as illustrated in FIG. 2. In this case the printing modules 10 and 10' are arranged opposed to one another in such a way that the guide rollers 22' for the intermediate carriers 14 or 14' overlap one another and thus form a single print transfer and fixing gap 29, through which the recording medium 21 is passed. The guide rollers can be spring-mounted to generate a corresponding print pressure on the recording medium 21. If necessary, correspondingly arranged stops ensure exact maintenance of the required fixing gap width which depends on the thickness of the recording medium. Analogously to the exemplary embodiment of FIG. 1, the inactive intermediate carriers 14, 14' of the printing modules can be swung away from the photoconductor drum with the aid of the motor device 18 or 18' respectively depending on the operating states (front/rear side printing, single-sided printing, alternating front/rear side printing, etc.). The design of the guide rollers, 22' can also be such that they can be swung in and out for this purpose. It is also possible to arrange paper rollers that can be correspondingly swung in and out before and after the print transfer and fixing gap 29 which ensure the necessary pressure of the recording medium against the guide rollers and guide the recording medium 21 safely in the gap respectively. Incidentally, it should also be noted that the relative specifications of rear side toner image, front side toner image, or rear side and front side of the recording medium are interchangeable relative specifications with respect to the relative position of the toner image on the recording medium.

The present invention is subject to many variations, modifications and changes in detail. It is intended that all matter described throughout the specification and shown in the accompanying drawings be considered illustrative only. Accordingly, it is intended that the invention be limited only by the spirit and scope of the appended claims.

I claim:

1. An electrophotographic printing device for printing rear end front sides of a recording medium comprising:

a first printing module having a first electrophotographic processing means for transferring and fixing a rear side image on a rear side of the recording medium, the first electrophotographic processing means comprising a first heated photoconductor drum and a first intermediate carrier for transferring the rear side image from the first photoconductor drum onto the rear side of said recording medium;

a second printing module having a second electrophotographic processing means for transferring and fixing a front side image on a front side of the recording medium, the second electrophotographic processing means comprising a second heated photoconductor drum and a second intermediate carrier for transferring the front side image from the second photoconductor drum onto the front side of said recording medium, the first and second printing modules being mounted opposite one another in the printing device to form a conveyor channel for the recording medium between the printing modules, wherein the recording medium is guided over guide means for bringing said front and rear sides respectively into contact with the first and second intermediate carriers of the respective printing modules without heating said recording medium.

2. The electrophotographic printing device of claim 1, wherein the guide means further comprises a guide roller and a counter roller, and wherein the counter roller presses the recording medium against the guide roller.

3. The electrophotographic printing device of claim 1, wherein the guide means comprises a pair of rollers which form a print transfer and fixing gap in the conveyor channel within which the recording medium passes.

4. The electrophotographic printing device of claim 3 wherein a first roller of the pair of rollers is moveable for disengaging the recording medium.

5. The electrophotographic printing device of claim 3, wherein a first roller of the pair of rollers is heated.

6. The electrophotographic printing device of claim 3, further comprising, an electromotor means for moving the first intermediate carrier into contact with the photoconductor.

7. The electrophotographic printing device of claim 1, wherein the first intermediate carrier is a thermal transfer belt.

8. The electrophotographic printing device of claim 1, further comprising first and second heating stations located adjacent to the corresponding first and second intermediate carriers in corresponding ones of said first and second printing modules, for heating toner to an almost liquid state.

* * * * *